United States Patent [19]

Kile

[11] Patent Number: 4,570,320

[45] Date of Patent: Feb. 18, 1986

[54] TOOL FOR ALIGNING ENGINE CYLINDER HEADS

[76] Inventor: Walter F. Kile, Box 77, Zion Hill, Pa. 18981

[21] Appl. No.: 691,161

[22] Filed: Jan. 14, 1985

[51] Int. Cl.[4] ..... B25B 27/14

[52] U.S. Cl. ..... 29/271

[58] Field of Search ..... 29/271, 272

[56] References Cited

U.S. PATENT DOCUMENTS 1,453,913 5/1923 Burdick ..... 29/271

FOREIGN PATENT DOCUMENTS 527781 10/1940 United Kingdom ..... 29/271

*Primary Examiner*—Frederick R. Schmidt
*Assistant Examiner*—Steven P. Schad
*Attorney, Agent, or Firm*—Z. T. Wobensmith, III

[57] ABSTRACT

A tool for aligning engine cylinder heads on engine blocks prior to final assembly of the head to the block, which tool is inserted in bolt holes in the head and block, permits of final gasket placement and inspection, the tool including a central body, a plurality of steel balls carried in an inclined passageway, a nose piece carried in the body engaged with one of said balls to force the other ball partially out of said inclined passageway and a handle for rotating the nose piece, to permit the balls to retract into the passageway and the head to pass over the tools and be guided down onto the block.

6 Claims, 5 Drawing Figures

TOOL FOR ALIGNING ENGINE CYLINDER HEADS

BACKGROUND OF THE INVENTION

1. Field of the Invention

This invention relates to a tool for aligning cylinder heads on engine blocks for assembly thereto.

2. Description of the Prior Art

One of the most difficult tasks in the rebuilding of internal combustion engines is the assembly of the cylinder head to the block after the final reconditioning work has been performed. Cylinder heads are heavy and difficult to maneuver for gasoline engines, but those used with diesel engines are much heavier and more difficult to position, the mechanic, during assembly, often catching his fingers or clothing between the cylinder head and the engine block.

After the work has been completed on the block and the head or heads, a cylinder head gasket, or in the case of diesel engines, several individual gaskets, are placed in various locations on the engine block. The head is then positioned on the block and the cylinder head bolts inserted through the bolt holes in the head into corresponding threaded holes in the engine block. Diesel engines, which have much higher compression ratios than gasoline engines as well as using individual gaskets, compound the problem should one or more gaskets become misaligned, which may result in compression loss, or other problems, and is usually not apparent until the engine has been completely assembled and test run. Correction of the problem requires tear down and reassembly.

Various solutions have been attempted, such as inserting threaded rods into the engine block bolt holes and placing the heads on them, but no satisfactory solution has been proposed wherein the mechanic is able to place the head above the block, check gasket alignment and then easily lower the head onto the block in a controlled and guided manner.

SUMMARY OF THE INVENTION

In accordance with the invention a tool for aligning cylinder heads on engine blocks is provided, having a central body which can be placed in bolt holes in a cylinder head and block, that carries two balls in an inclined passageway one of which can be forced partially out past the outside of the body by a rotatable nose piece to engage a cylinder head, the gasket position is checked, and then by counter-rotation of the nose piece the balls are retracted into the passageway to let the cylinder head pass down the body onto the engine block. The tool is then withdrawn and the head bolts inserted and tightened for assembly.

The principal object of the invention is to provide a tool for aligning cylinder heads which can be used with a variety of engines.

A further object of the invention is to provide a tool of the character aforesaid which reduces the time necessary to assemble cylinder heads to engine blocks.

A further object of the invention is to provide a tool of the character aforesaid which provides for visual inspection of gasket placement prior to final assembly of the head to the engine block.

A further object of the invention is to provide a tool of the character aforesaid which is easy to use and is durable in service.

A further object of the invention is to provide a tool of the character aforesaid which reduces the likelihood of injury to the user who is assembling cylinder heads to engine blocks.

Other objects and advantageous features of the invention will be apparent from the description and claims.

DESCRIPTION OF THE DRAWINGS

The nature and characteristic features of the invention will be more readily understood from the following description taken in connection with the accompanying drawings forming part hereof in which.

Figure 1:
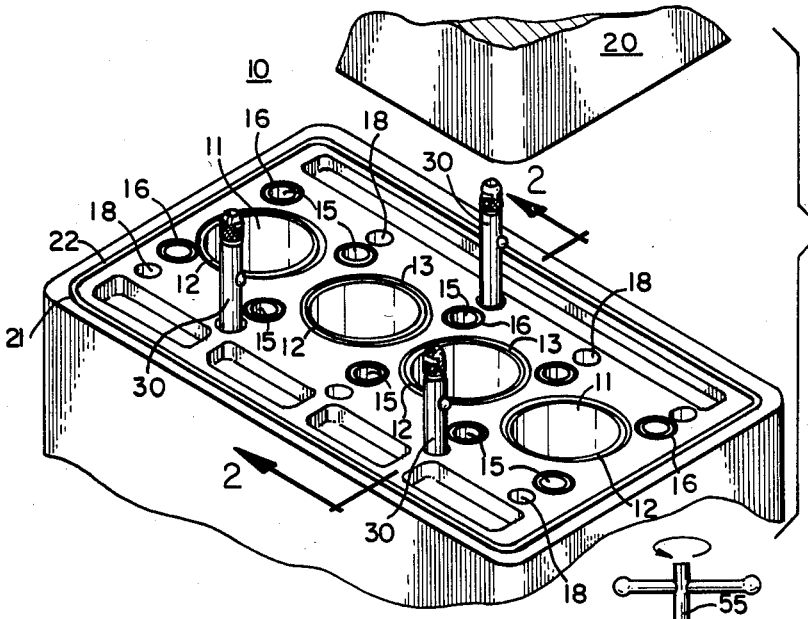
FIG. 1 is an exploded perspective view of an engine block which is illustrated with three tools of the invention therein.

It should, of course, be understood that the description and drawings herein are illustrative merely and that various modifications and changes can be made in the structure disclosed without departing from the spirit of the invention.

Like numerals refer to like parts throughout the several views.

DESCRIPTION OF THE PREFERRED EMBODIMENTS

Referring now more particularly to the drawings and FIGS. 1 to 5 thereof, an engine block 10 is illustrated, which is of the conventional type and is illustrated as it would appear for a four cylinder diesel engine. The block 10 includes four bores 11 which carry pistons (not shown), and with gaskets 12 carried in grooves 13 at the top surface 14 of the block 10. The block 10 also has a plurality of passageways 15 which carry coolant, and which are also provided with gaskets 16 in grooves 17 at the top surface 14 of the block 10.

The block 10 is provided with threaded bolt holes 18 to receive bolts (not shown) extending down from a cylinder head 20.

The engine block 10 is also provided with a perimeter groove 21 which has a gasket 22 therein.

The cylinder head 20 which is shown in fragmentary form, includes a bottom surface 25 which mates with the top surface 14 of block 10 and with appropriate internal structure common to diesel engines (not shown) for operation. The head 20 includes a plurality of bolt holes 26 therethrough, which correspond to the holes 18 in block 10 and which receive cylinder head bolts (not shown) of well known type to secure the head 20 to block 10 in well known manner.

Figure 2:
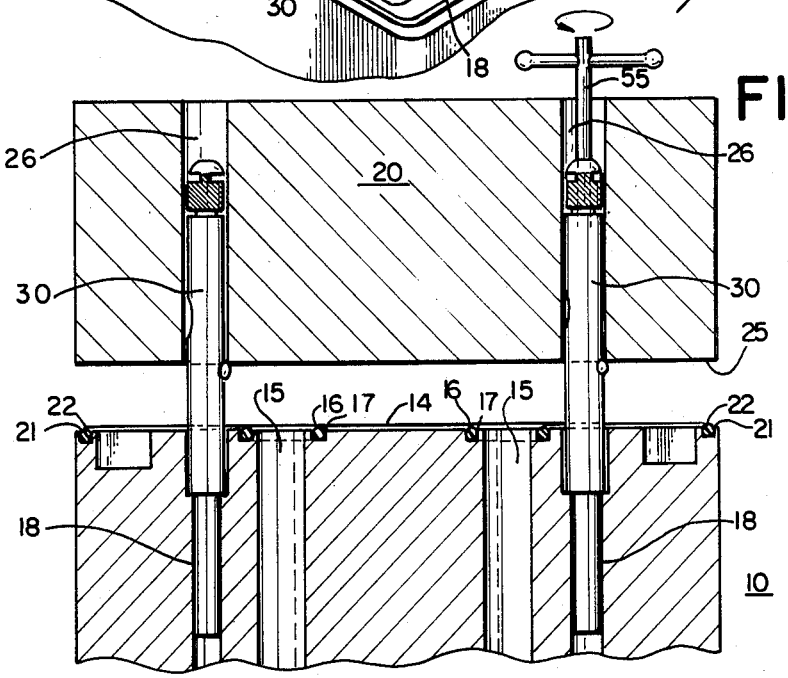
FIG. 2 is a vertical sectional view, taken approximately on the line 2—2 of FIG. 1, illustrating a cylinder head carried on and supported by the tools of FIG. 1, above the block.
Figure 4:
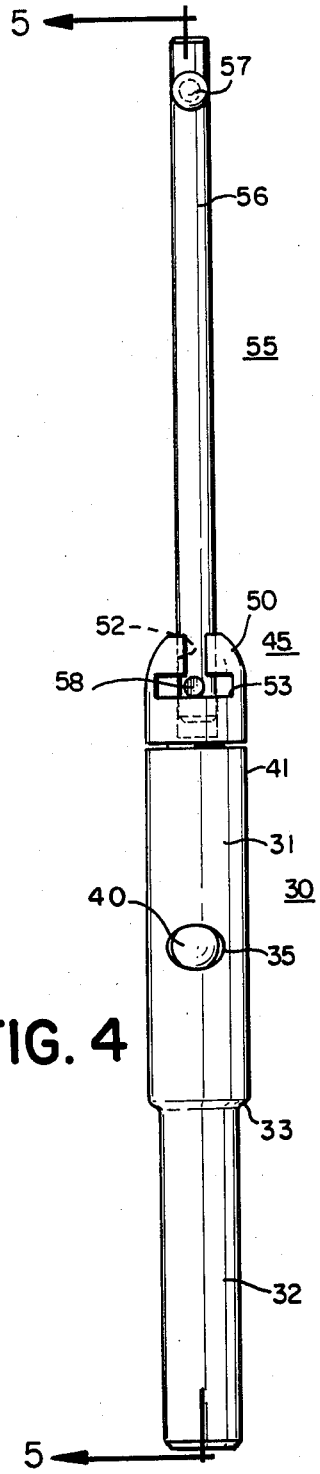
FIG. 4 is a side elevational view of the tool of the invention.
Figure 5:
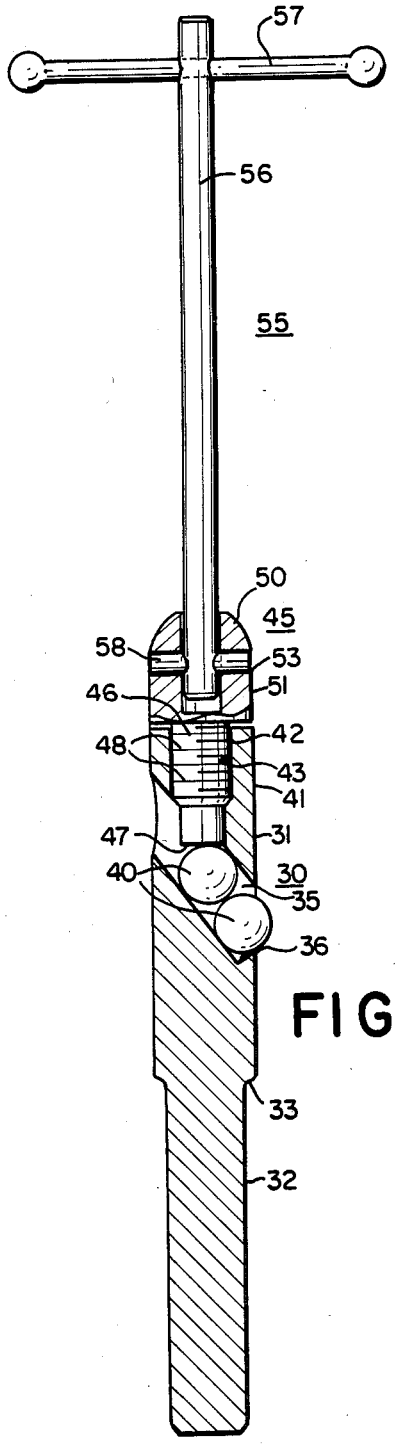
FIG. 5 is a vertical sectional view, taken approximately on the line 5—5 of FIG. 4.

One embodiment of the tool 30 of the invention is particularly illustrated in FIGS. 4 and 5, and includes a central body 31, with an extension 32 which can fit in the threaded bolt holes 18 in block 10, as shown in FIGS. 1 and 2.

The central body 31 and extension 32 are preferably formed of hardened steel, and are of cylindrical configuration with a shoulder 33 at the junction of body 31 and extension 32.

The central body 31 is provided with an inclined passageway 35 which is at an angle of 45° to a vertical centerline through the body 31, which passageway is open at the left as seen in FIG. 5, and has a retaining shoulder 36 at the lower right thereof.

Two balls 40, which can be of hardened steel, are shown in passageway 35 and which are restrained from exiting the passageway 35 at the lower right by the shoulder 36, but one of which can partially exit the passageway 35 past the outer surface 41 of the central body 31.

A longitudinal bore 42 is provided which intersects the passageway 35 and is provided with threads 43.

A nose piece 45 is provided, which has an extension 46, with a flat end surface 47 to engage the uppermost one of the balls 40, and which has threads 48 engaged with the threads 43 in body 31. The nose piece 45 has a knob 50 extending from portion 48, which may be knurled as illustrated at 51 for ease of gripping, and is also provided with a vertical slot 52 and two horizontal slots 53. A T-handle 55 is provided which includes a vertical rod 56, a handle 57 and a pin 58 which can engage in the slots 53 for rotation of the nose piece 45. The threads 43 and 48, in the preferred embodiment, are right hand threads, but if desired can be left hand threads, which may be desirable for some installations.

The mode of operation and use will now be described.

Figure 3:
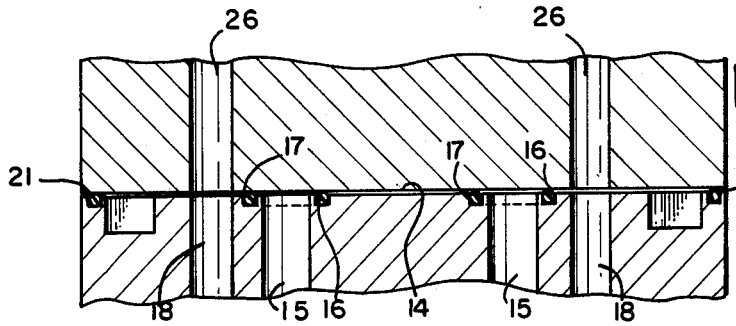
FIG. 3 is a view similar to FIG. 2, but with the head positioned on the block and the tools removed.

When the repair or reconditioning work has been completed on an engine block 10, such as that shown in FIGS. 1 to 3, then the gaskets 12, 16, and 22 are inserted in their respective grooves 13, 17, and 21.

A tool 30 is grasped in the user's hand (not shown) and the nose piece 45 is rotated in the appropriate right or left hand direction to cause balls 40 to move down in passageway 35 until the lowermost one protrudes out past the surface 41, and which is restrained from further movement by shoulder 36. The extension 32 is placed in a bolt hole 18 in block 10, and while one tool 30 is described and could be used, it is more advantageous to use at least three tools 30, and more if desired or where a large engine is involved. A cylinder head 20 is placed over the tools 30, which extend into bolt holes 26 and is restrained from downward movement by surface 25 contacting ball 40. Final inspection can be made of the alignment of gaskets 12, 16 and 22, and corrections made if desired. The T-handle 55 is inserted into slots 52 and 53 and rotated clockwise or counterclockwise dependent on the hand of threads 43 and 48, which permits the balls 40 to move upwardly in passageway 35, and the surface 25 to move down past the end of passageway 35 until it contacts surface 14 of block 10. The T-handles 55 and tools 30 may then be withdrawn from bolt holes 18 and 26, and bolts (not shown) inserted thereinto and appropriately tightened.

It will thus be seen that a tool has been provided with which the objects of the invention are achieved.

I claim:

1. A tool for alignment and assembly of cylinder heads to engine blocks wherein the block is provided with a plurality of holes and the head is provided with a plurality of holes, the tool to be inserted in said holes and which comprises a central body, a longitudinal threaded bore in said central body, an inclined passageway in said body intersecting said bore, at least two balls carried in said passageway, a shoulder in said passageway retaining said balls therein but permitting partial exit of one ball outside of said body, wherein the ball is adapted to support said head above said block prior to its engagement with said block, nose piece means in threaded engagement in said central body, rotation of which in one direction permits said balls to move into said passageway and rotation in the other direction forces a portion of one ball to be partially outside said body, an extension connected to said central body and engaged in said holes in said block, and handle means for engagement of said nose piece and rotation thereof for ball movement and tool withdrawal.

2. A tool as described in claim 1 in which said balls are of hardened steel.

3. A tool as described in claim 1 in which said nose piece rotation for ball retraction is clockwise.

4. A tool as defined in claim 1 in which said nose piece rotation for ball retraction is counterclockwise.

5. A tool as defined in claim 1 in which said nose piece means includes a knurled head, and an extension which engages one of said balls.

6. A tool as defined in claim 1 in which said passageway intersects said bore at an angle of forty-five degrees.

* * * * *